United States Patent [19]

Pretchel et al.

[11] Patent Number: 4,955,824

[45] Date of Patent: Sep. 11, 1990

[54] TWO PIN SHUNT

[76] Inventors: David A. Pretchel, 8549 Plank Rd., Mentville, Ohio 44064; Howard J. Venaleck, 232 Wintergreen Hill, Painesville, Ohio 44077; John T. Venaleck, 2132 Chimney Ridge, Madison, Ohio 44057

[21] Appl. No.: 269,589

[22] Filed: Nov. 10, 1988

Related U.S. Application Data

[60] Division of Ser. No. 38,228, Apr. 14, 1987, Pat. No. 4,795,602, and a continuation-in-part of Ser. No. 841,669, Mar. 19, 1986, abandoned.

[51] Int. Cl.[5] ..... H01R 31/08

[52] U.S. Cl. ..... 439/510

[58] Field of Search ..... 439/510, 736, 507, 513; 339/19, 222, 218 R, 218 M

[56] References Cited

U.S. PATENT DOCUMENTS

| | | | |
|---|---|---|---|
| 3,241,096 | 3/1966 | Miller | 439/654 |
| 3,328,504 | 6/1967 | Hamel | 264/272.14 |
| 4,283,100 | 8/1981 | Griffin et al. | 439/510 |
| 4,449,771 | 5/1984 | Carr | 439/510 |
| 4,516,175 | 5/1985 | Deters | 439/510 |

*Primary Examiner*—Neil Abrams

*Attorney, Agent, or Firm*—Renner, Otto, Boisselle & Sklar

[57] ABSTRACT

An electrical shunt includes a U-shape contact having a unitary body molded directly in a housing into which pin contacts may be inserted for connection to and via the shunt.

11 Claims, 4 Drawing Sheets

FIG. 1
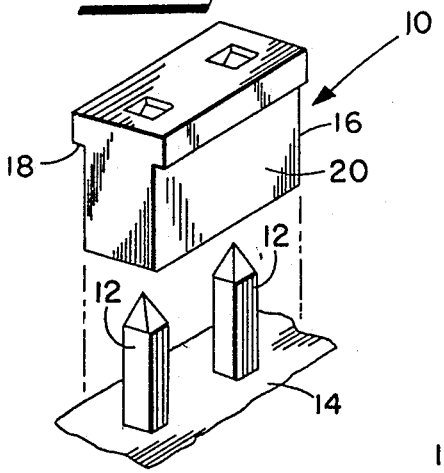
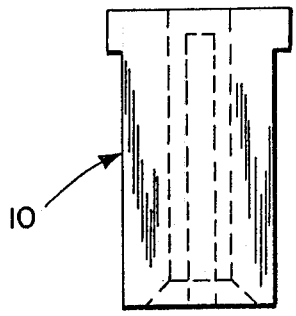
FIG. 5
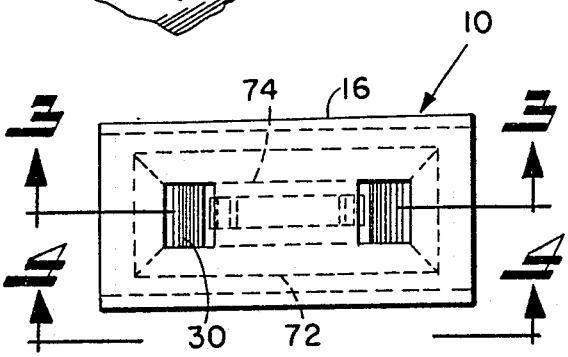
FIG. 2
FIG. 4
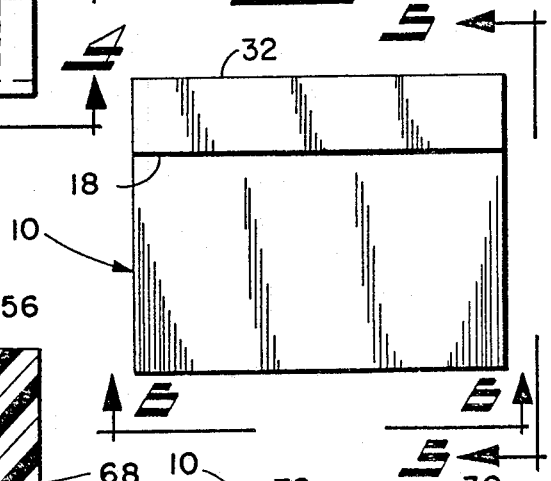
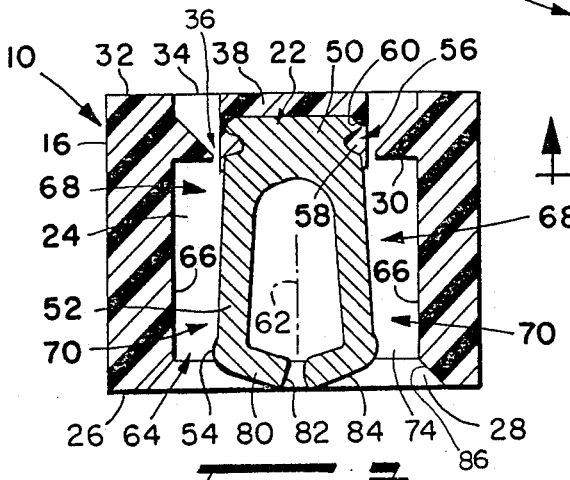
FIG. 3
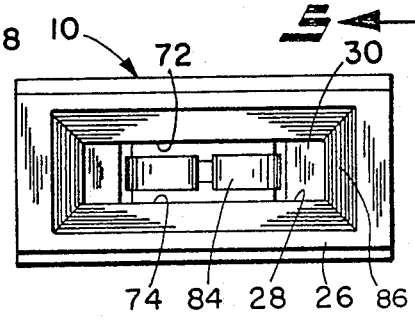
FIG. 6

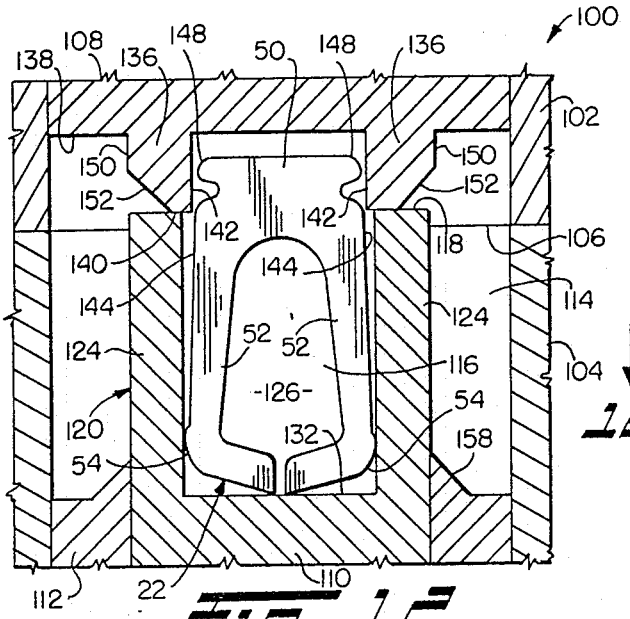
FIG. 12
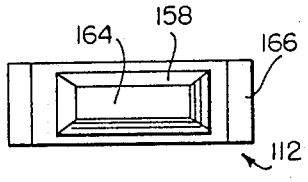
FIG. 18
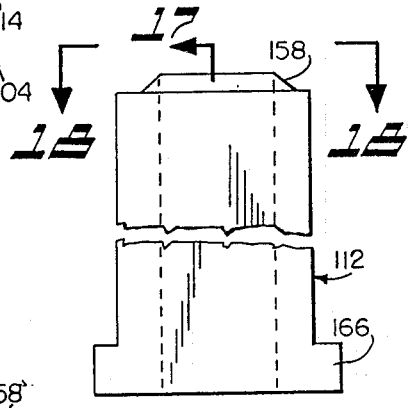
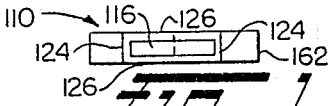
FIG. 15
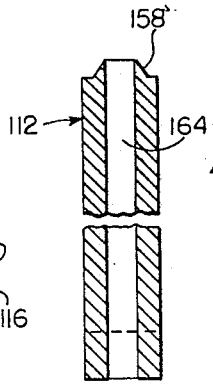
FIG. 16
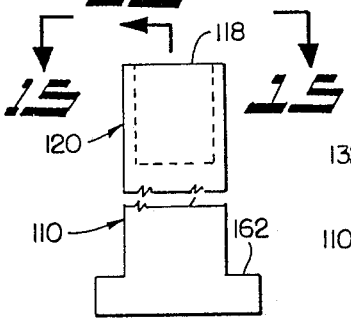
FIG. 13
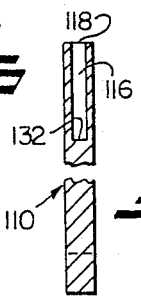
FIG. 14
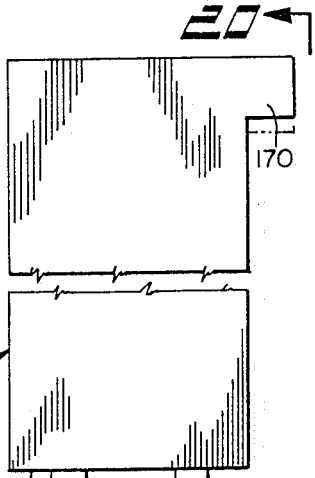
FIG. 19
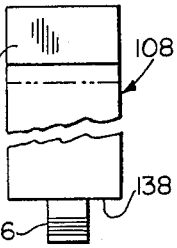
FIG. 20

TWO PIN SHUNT

RELATED APPLICATION DATA

This application is a division of copending U.S. patent application Ser. No. 038,228, filed Apr. 14, 1987, now U.S. Pat. No. 4,795,602, which is a continuation-in-part of copending U.S. patent application Ser. No. 841,669, filed Mar. 19, 1986, now abandoned, which is hereby incorporated herein by reference.

TECHNICAL FIELD

The present invention relates generally, as indicated, to electrical shunts, and, more particularly, to a two pin shunt or jumper type device for connecting two electrical contacts or conductor members. The invention also relates to molding apparatus and methods for making electrical shunts.

BACKGROUND

In the electronics industry it has become common to manufacture an electrical device capable of use in plural respective modes. A mode may be selected by the installation or removal of an electrical shunt, closing or opening one or more switches, and so on. As one example, when multiple fixed disk drives (sometimes referred to as hard disks) are connected in daisy chain relation to a computer, each drive number can be set by the user installing an electrical shunt across a pair of pin contacts or terminals of each fixed disk drive. Another example for use of a shunt is in random access memory circuits used with computers. Such circuits often have the ability to alter the starting memory location address by the shunting of a respective pair of terminals or pin contacts associated with the circuit. Accordingly, a user may install a shunt to connect an appropriate pair of such terminals depending on the already existing amount of memory in the computer with which the new random access memory circuit is to be used.

Electrical shunt devices of the type to which the present invention relates typically are installed on a pair of contacts to provide an electrical interconnection thereof. Such contacts may take various forms. The detailed description below refers to one of the more preferred contact forms with which such shunts are employed, namely the male pin type of contact or terminal. It will be appreciated that various aspects of the invention may be employed to provide electrical shunt function with respect to other types of contacts. Such pin contacts typically are soldered into place in a plated through hole of a printed circuit board for mechanical support by the board and electrical connection with a circuit trace thereon. As another example, the pin contacts may be part of a header or other device or devices that carry a plurality of such pin contacts; and the header(s) or other devices may themselves be attached to a printed circuit board or other support structure, as, of course, is well known. It will be appreciated that although the present invention is described for use particularly with pin contacts, various features of the invention may be employed with other types of contacts to effect the desired shunting function.

SUMMARY OF THE INVENTION

The present invention is directed to an electrical shunt device including an electrical contact for electrically connecting plural external members inserted to engagement therewith, the contact having plural contacting portions for electrically connecting respectively to such external members, and an electrically non-conductive housing directly molded to at least part of the contact and substantially enclosing the contact while providing an entry path for such external members to be inserted into the housing for electrical engagement with respective contacting portions of the contact, whereby the contact effects shunting of such external members. The external members may be pin contacts, leads of an electrical or electronic component, terminals, such as those used on a wire wrap board or header, or other electrically conductive members which are intended to be electrically connected by the electrical shunt of the invention. Hereinafter, such members will be referred to as electrical members or external members.

According to one aspect of the present invention, an electrical shunt includes a contact for electrically connecting plural electrical members, the contact having plural contacting portions for electrically connecting respectively to plural electrical members, and a housing for supporting the contact in operative position for effecting such connection function with respect to such plural electrical members inserted with respect to the housing and contacting portions, the housing being open at one side for exposing the contacting portions for connection to the electrical members, and the contact comprising a unitary contact body molded directly in place in at least part of the housing, whereby the housing and contact form an integral structure.

According to another aspect of the invention, an electrical shunt includes a contact for electrically connecting plural electrical members, the contact having plural contacting portions for electrically connecting respectively to plural electrical members, and a housing for supporting the contact in operative position for effecting such connecting function with respect to such plural electrical members inserted with respect to the housing and contacting portions, the housing having an opening at one side for exposing contacting portions for connection to such electrical members, the contact comprising a unitary generally U-shape contact body including a base portion and the contacting portions, the contacting portions extending from the base portion generally in a paired parallel direction simultaneously to engage respective electrical members inserted simultaneously into the housing and into engagement with the contacting portions.

According to an additional aspect, the contact has a resiliency characteristic whereby insertion of electrical members into engagement with the contacting portions effects balanced resilient deformation of the contacting portions; as still an additional aspect, the contacting portions include travel stops engageable with each other to prevent over-stressing of the contact.

According to a further aspect, an electrical shunt comprises a contact for electrically connecting plural electrical members, the contact having plural contacting portions for electrically connecting respectively to plural electrical members, and a housing for supporting the contact in operative position to effect such connecting function, the housing having opening at one side for exposing therewithin the contacting portions for connection to such electrical members inserted in a generally linear fashion into the housing, the contacting portions being positioned relatively proximate the opening to engage the electrical members upon insertion thereof into the housing, and the housing having a stop at a second side opposite the opening side and relatively remotely located with respect to the contacting portions to limit maximum insertion penetration of the electrical members into the housing and to block insertion of the electrical members into the housing from such second side, and the contact being molded directly in place in at least part of the housing, whereby the housing and contact form an integral structure.

According to still another aspect of the invention, an electrical shunt comprises a contact for electrically connecting plural electrical members, the contact having plural contacting portions for electrically connecting respectively to plural electrical members, and a housing for supporting the contact in operative position for effecting the connecting function, the housing having first opening at one side for exposing the contacting portions for connection to such electrical members and to receive upon insertion therethrough such electrical members, and a second opening at the opposite side of the housing for passing therethrough the electrical members for exposure thereof at such opposite side, the contact being molded directly in place in at least part of the housing, whereby the housing and contact form an integral structure.

A still further aspect of the invention relates to a method of making an electrical shunt formed of an electrically conductive contact having plural contacting portions for connection with respect external members inserted to connection therewith to effect shunting of the same and an electrically non-conductive housing, comprising molding electrically non-conductive material directly to at least part of the contact to form the housing, whereby the housing and contact form an integral structure, and the molding including forming relatively open chamber areas within the housing for exposure therein of the contacting portions, and forming opening means in the housing for insertion therein of the respective external members for electrical connection with respective contacting portions.

One advantage of the invention is the ability to perform the shunt function using a rather small device that minimizes the amount of space required to accommodate the same; this feature can help to minimize the space required between circuit boards or the like. Another advantage of the invention is the relatively high level of compliance of the contacting portions facilitating installation and effective electrical interconnection functions while preferably also avoiding damage to the contacts due to an over-stress condition. According to one embodiment, closure or substantial closure of one side of the shunt housing helps assure proper installation and maintenance of relatively clean conditions in the contacting area. In another embodiment of the invention openings at both sides of the shunt housing provide the capability of stacking plural shunts and/or exposure of pin contacts that are shunted. Stacking of plural shunts on one pair of pin contacts increases the effective current carrying capacity therebetween. Stacking of plural shunts on three pin contacts facilitates interconnection of said contacts. Various features of the invention facilitate manufacturing of the electrical shunt and secure retention of the contact in the shunt housing.

These and other objects, advantages, features and aspects of the invention will become more apparent from the following description.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

In the annexed drawings:

FIG. 1 is an exploded isometric view depicting the position and relation of an electrical shunt in accordance with the present invention relative to a pair of pin contacts;

FIG. 2 is a top plan view of the shunt of FIG. 1;

FIG. 3 is a section view of the shunt looking in the direction of the arrows 3—3 of FIG. 2;

FIG. 4 is a side elevation view of the shunt looking generally in the direction of the arrows 4—4 of FIG. 2;

FIG. 5 is an end elevation view of the shunt looking generally in the direction of the arrows 5—5 of FIG. 4;

FIG. 6 is a front (also a bottom) view of the shunt looking generally in the direction of the arrows 6—6 of FIG. 4;

FIG. 12 is a partial section view of a mold having use in the manufacture of the electrical shunt, the mold being shown with the contact inserted therein and in closed condition prior to molding of the housing of the shunt;

FIG. 13 is a reduced fragmentary side elevation view of a lower core pin which forms a part of the mold of FIG. 12;

FIG. 14 is a fragmentary section view of the lower core pin looking in the direction of the arrows 14—14 of FIG. 13;

FIG. 15 is a top plan view of the lower core pin looking generally in the direction of the arrows 15—15 of FIG. 13;

FIG. 16 is a reduced fragmentary side elevation view of a stripper pin which forms a part of the mold of FIG. 12;

FIG. 17 is a fragmentary section view of the stripper pin looking generally in the direction of the arrows 17—17 of FIG. 16;

FIG. 18 is a top plan view of the stripper pin looking generally in the direction of the arrows 18—18 of FIG. 16;

FIG. 19 is a reduced fragmentary side elevation view of an upper core pin which forms a part of the mold of FIG. 12;

FIG. 20 is a fragmentary end elevation view of the upper core pin looking generally in the direction of the arrows 20—20 of FIG. 19;

DESCRIPTION OF THE PREFERRED EMBODIMENTS

Figure 7:
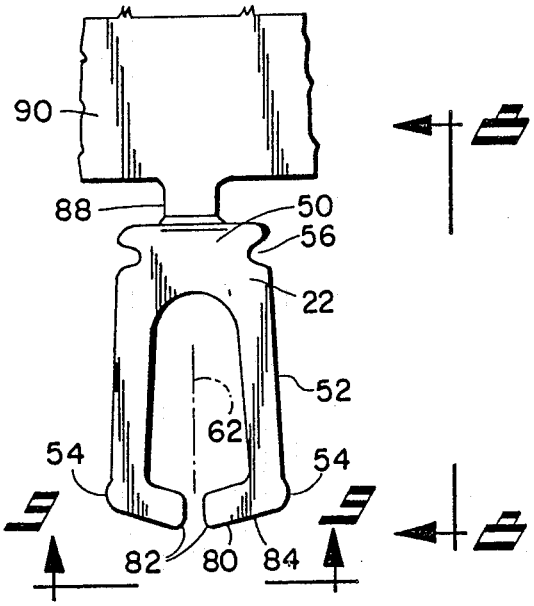
FIG. 7 is a side elevation view of a contact used in the shunt in accordance with the invention.

Referring, now, in detail to the drawings, wherein like reference numerals designate like parts in the several figures, and initially to FIG. 1, an electrical shunt in accordance with the present invention is generally designated 10. The electrical shunt 10 may be installed, for example manually, on a pair of pin contacts 12 to effect electrical interconnection thereof. The contacts 12, themselves, in turn may be mounted on a printed circuit board 14. The electrical shunt 10 includes an electrically non-conductive body or housing 16, which may be grasped manually, for example, to enable manual installation or removal of the shunt with respect to the pin contacts 12. Ledges 18 may be formed on the sides of the exterior surface 20 of the housing 16 to facilitate manipulation of the electrical shunt 10. As shown, the ends of the exterior surface need not have such ledge.

Turning, now, more particularly to FIGS. 2–6, the fundamental components of the electrical shunt 10 in accordance with the present invention include the housing 16 and an electrical contact 22. The housing 16 is formed of electrically non-conductive material that preferably is molded using injection molding techniques. Preferably the housing 16 is molded with the contact 22 in place in the mold so that during the molding process part of the housing is molded directly to part of the contact thus forming the electrical shunt 10 as a completely integral structure. Preferably no additional means is required to secure the contact in the housing other than the direct molding of the housing to the contact. As is seen in FIG. 3, for example, the housing 16 has a hollow interior chamber or cell area in which the major portion of the contact 22 is located. At the bottom or front side 26 of the housing 16 is an opening 28 into which the pin contacts 12, for example, or other external electrically conductive members, contacts, or the like, may be inserted into the chamber 24 for connection with the contact 22 and, accordingly, with each other via the electrically conductive path provided by the contact 22.

Ordinarily the pin contacts 12 would be inserted through the opening 28 into the chamber 24 in a generally linear insertion direction or fashion while effecting engagement with the contact 22. Stop surfaces 30 at the remote or distal end of the chamber 24 relative to the opening 28 limit the maximum insertion of the pin contacts 12 and stop further travel of such contacts. The stops 30 also prevent incorrect installation of the electrical shunt 10 from the back or top side 32 thereof. Specifically, at the top 32 are openings 34 part way into the housing 16 chamber 24; but the pathway from such openings 34 into the chamber 24 substantially is blocked by the stops 30, as is most clearly seen in FIGS. 2 and 3. The stops 30 also tend to block the entry of dust, dirt, and other material from entering the chamber 24 when the jumper is installed; although there is a small gap 36 joining each opening 34 with the chamber 24, such gap is relatively small and severely limits the entry of foreign matter into the chamber 24.

The triangular cross-sectional shape of the stops 30 and the gap separation 36 help to minimize the amount of material required to form the housing 16. Additionally, it is noted that the separation of the stops 30 from the main housing support structure 38 at the gaps 36 also can facilitate the process of molding the housing to the contact to form an integral structure thereof.

As is seen most clearly in FIGS. 3 and 6–9, the contact 22 is generally of U-shape configuration and is formed of a unitary body or structure. The contact 22 has a base 50 from which extend a pair of legs 52, which support the contacting portions 54 of the contact which are intended to engage and to make electrical connection with the respective surfaces of inserted pin contacts 12.

At least a portion of the contact base 50 is molded in place within the main housing support structure 38 of the housing 16, as is seen most clearly in FIG. 3. To help secure the contact 22 in place, the base 50 has recesses or cut-outs 56 into which the molding material may flow during the molding process; when solidified or frozen, such material 58 helps to secure the contact 22 in the housing, specifically in the main housing support structure 38, as pin contacts 12 are inserted and withdrawn with respect to the chamber 24 of the shunt 10. Sloped surfaces 60 at the back of the contact 22 facilitate accurate positioning of the contact and molding equipment to assure proper formation of the housing 16 during molding thereof, molding of the main housing support structure 38 relative to the contact 22, and proper orientation of the contact in the shunt chamber 24.

Being able to facilitate orientational accuracy of the contact in the housing in addition to the direct molding of the housing material to the contact itself improve the quality control of electrical shunts 10 in accordance with the present invention and also reduce manufacturing labor requirements of the prior art in which typically the electrical contact of a shunt device would have to be installed into an already molded housing as a separate procedure after molding is completed. In the prior art such additional insertion step may result in misalignment or improper positioning of the contact into the housing or even may cause damage to the contact or housing. These disadvantages of prior art electrical shunts are overcome in the present invention as is evident from the description herein.

The contacting portions 54 of the contact 22 are curved so as to provide an interference fit with pin contacts inserted into the chamber 24 and to slide relatively smoothly along pin contacts as they are inserted. As the pin contacts and connecting portions slide in engagement with each other during such insertion, the wiping action therebetween helps to assure effective electrical connection between the pin contacts 12 and the contact 22.

The contact legs 52 extend away from the base 50. However, the legs are slightly angled relative to a longitudinal axis 62 of the contact so that there is a relatively narrower space 64 between the contacting portion 54 and interior wall 66 of the housing and a relatively wider space between the housing wall 66 and the contact leg 52 more proximate the base 50, e.g. in the area designated 68 in FIG. 3. Thus, the contact leg 52, and more particularly the contacting portion 54 thereof, as well as the housing wall 66 define two sides of a cell area 70 into which a pin contact 12 may be inserted. Two other walls or sides of the cell 70 are formed by the interior walls 72, 74 of the housing 16. Although the chamber 24 preferably is generally an open area, the side walls 66, 72 and 74 thereof cooperate with the contact legs 52 to form individual cells 70 into which pin contacts may be inserted. Since the area between the contact legs 52 preferably is open and free of housing material and since the contact legs 52 generally are free to move or to bend during insertion or removal of pin contacts 12 with respect to the shunt 10, compliance considerations of the contact 22 primarily will be a function of the resiliency or stiffness characteristics of the contact, the dimensions of the legs themselves, and the interaction of the legs relative to the base 50. It is desired that the resiliency characteristics of the contact 22, and, in particular the legs 52, assure that the contacting portions 54 exert adequate force against inserted pin contacts to provide good retention of the shunt 10 on the contacts 12. Moreover, the preferred unitary U-shape of the contact 22 helps assure balancing of the forces on the legs 52 as they are resiliently deformed to minimize possibility of overstressing either leg.

It is, of course, desirable to avoid overstressing the contact 22 such that either or both of the legs 52 might otherwise be deformed beyond elastic limit. For this purpose the leading ends of the contact legs 52 relatively remote from the base 50 have stops 80. More specifically, each of the stops 80 has a stop surface 82 which engage each other when one, the other, or both of the legs 52 are deformed beyond a prescribed or permitted amount. Such excessive deformation or effort to effect the same may be due to too large a pin contact 12 for the shunt 10, one or more misaligned pin contacts 12, or incorrect spacing of the pin contacts 12 relative to the spacing for which the shunt 10 is intended. Thus, the stops 80 and stop surfaces 82 prevent overstressing and damage of the contact 22 due to such incorrect sizing or misalignment circumstances while still permitting a relatively high tolerance or compliance for such misalignment or mis-sizing; specifically, if one pin contact were properly sized and properly oriented, it would be insertable into one of the cells 70 with relatively minimum deformation of one of the contact legs 52, while maximum deformation of the other contact leg still would be permitted until the stop surfaces 82 would come into engagement, thus permitting a relatively maximum tolerable misalignment or mis-sizing of the second pin contact.

The open front side 26 of the shunt 10 is seen most clearly in FIGS. 3 and 6. The leading surfaces 84 of the contact stops 80 are sloped somewhat compatibly with the slope of the entrance surfaces 86 of the opening 28. Therefore, the contact leading surfaces 84 and the sloped or tapered housing walls 86 cooperate to provide a tapered smooth entranceway into the two cells 70 of the electrical shunt 10.

Figure 8:
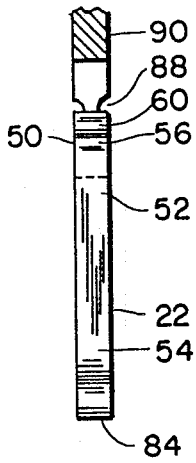
FIG. 8 is an end elevation view of the contact looking generally in the direction of the arrows 8—8 of FIG. 7.
Figure 9:
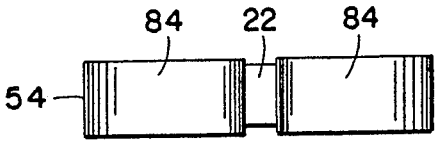
FIG. 9 is a front (or bottom) view of the contact looking generally in the direction of the arrows 9—9 of FIG. 7.

Briefly referring to FIGS. 7, 8 and 9, the contact 22 is shown in detail. The contact 22 may be formed of copper alloy material, such as nickel silver strip stock. The contact 22 may be cut from such strip stock, e.g. by a stamping process. As is seen in FIGS. 7 and 8, the contact itself may be connected at a break-away tab 88 to a support strip 90 that facilitates manipulation of the contact 22 for insertion thereof into a mold at which the housing 16 is to be molded. Upon such insertion of the contact 50 into the mold the break-away tab 88 may be flexed to break the same away from the contact base 50, thus leaving the contact properly positioned in the mold. The mold itself then may be closed and appropriate cavities therein filled with plastic or other molding material to form the housing. Exemplary molding material may be a glass filled electrically non-conductive plastic or plastic-like material, or other material that has suitable strength and electrical insulating characteristics and also is capable of being molded using plastic injection molding techniques.

Figure 10:
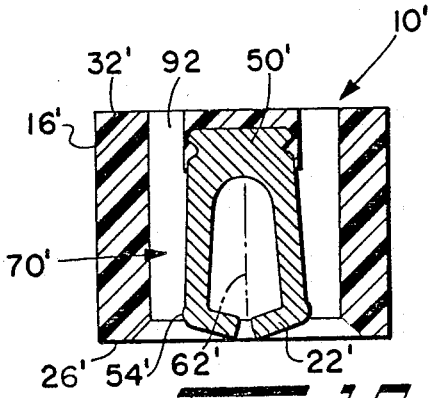
FIG. 10 is a section view similar to that of FIG. 3 and looking generally in the direction of the arrows 3—3 of FIG. 2, but depicting a modified electrical shunt in accordance with the invention having an open back (or top) exposure.

A modified electrical shunt 10' is illustrated in FIG. 10. Various parts of the shunt 10' which correspond to the parts of the shunt 10 described above with reference to FIGS. 1–9 are identified by primed reference numerals. The shunt 10' does not include the stops 30 of the shunt 10. Therefore, the cells 70' in the shunt housing 16' provide a path through the housing from the open front 26' to the respective openings 92 at the back 32'. The various other parts of the shunt 10' and the operation thereof are substantially the same as the parts and operation described above with respect to the shunt 10.

An important advantage of the shunts 10 and 10' according to the present invention is that by molding the contact directly and integrally in the housing and using the unitary body contact preferably of U-shape configuration, the overall height dimension of the shunt, e.g. along a direction parallel to the axis 62, is relatively minimal, as additional means to position, to align, to secure, etc. the contact in the housing are not required. Thus, the so-called height above board requirement for the shunt 10 to make effective electrical connection of the pin contacts 12 and to assure secure positioning of the shunt on the board is minimized, while also maintaining good compliance characteristics.

Figure 11:
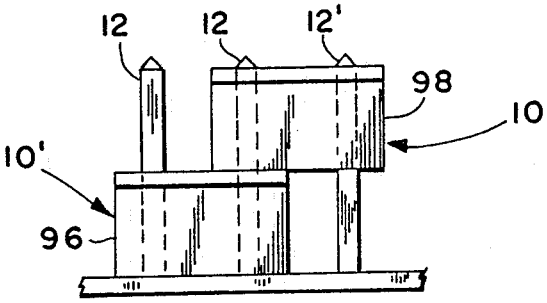
FIG. 11 is a somewhat schematic view depicting use of plural shunts in a stackable configuration with respect to plural pin contacts.

An advantage of the small height dimension characteristic and the open cells 70' of the shunt 10' is that the shunt may be installed on a pair of pin contacts, as the shunt 96 is installed in FIG. 11. Part of the pin contacts 12 pass fully through the cells 70' of the shunt 96 and are exposed for further electrical connection or other purposes. Indeed, further taking advantage of the low height dimension of the shunt 10', an additional such shunt 98 shown in FIG. 11 may be installed on the exposed end of one of the contacts 12 and a still further contact 12'. Thus, two shunts 10' may be used to interconnect three pin contacts in the manner illustrated in FIG. 11.

With reference to FIGS. 12–24, a preferred method of making the above described shunt 10 will now be described. Initially looking at FIG. 12, a mold 100 for carrying out the method can be seen to include opposed mold parts or halves 102 and 104 which mate along a parting line 106. For ease in description and not by way of limitation, the mold halves 102 and 104 are herein referred to as the upper mold half and the lower mold half, respectively. Although reference will be made to upper and lower, top and bottom, etc. in relation to the several figures, it will be appreciated by one having ordinary skill in the art that the mold 100 may be differently oriented, if desired.

In the illustrated preferred molding apparatus, the mold 100 further includes as separate parts thereof an upper core pin 108, a lower core pin 110, and a stripper pin 112. The upper mold half 102, lower mold half 104, upper core pin 108, lower core pin 110 and stripper pin 112 together define a mold cavity 114.

The lower core pin 110 has at its upper end a cavity 116 which opens to the top surface 118 of the lower core pin. The cavity 116 is generally of rectangular box shape and gives the upper end of the core pin an O-shape in transverse cross section. Accordingly, the upper end of the lower core pin 110 provides a hollow mold core 120 which may be referred to as an O-core by reason of such characteristic cross-sectional shape which is particularly adapted for use with the contact 22 or similar flat planar contacts of U-shape.

The mold core cavity 116 is sized and configured to receive therein the legs 52 of the contact 22 as shown in FIG. 12. When the contact is inserted into the cavity, the contacting portions 54 of the contact preferably loosely engage adjacent cavity end walls 124. The width of the cavity, i.e., the spacing between the end walls 124, preferably is great enough so that the contact can be inserted into the hollow core without having to flex the contact legs 52 towards one another. Otherwise, too much force may be required to insert the contact when considering that the contact preferably would be attached to a contact comb and inserted simultaneously with other contacts into respective hollow cores associated with respective mold cavities in the mold 100. That is, the spacing between the opposed cavity end walls 124 is equal or slightly greater than the width of the contact at the contacting portions 54 when the contact legs 52 are in their unflexed condition.

The side walls 126 of the cavity 116 are spaced apart in relation to the thickness of the contact 22 so that they engage adjacent sides of the contact with a close fit, i.e., with a close fit side-to-side. At least in an area adjacent the top surface 118 of the core pin the cavity side walls 126 and respective sides of the contact engage to provide a shut-off to prevent during molding flow of molten material therebetween and into the cavity 116.

The depth of the cavity 116 preferably is selected so that when the contact 22 is inserted to engagement at its front end with the bottom wall surface 132 of the cavity, the base 50 of the contact projects upwardly from the top surface 118 of the core pin 110. Accordingly, the bottom wall surface 132 of the cavity functions as a positive stop for determining the proper insertion depth of the contact into the cavity while leaving projecting therefrom the desired portion of the base to which the shunt housing 16 (FIG. 3) is molded during the molding operation.

When the mold 100 is closed as seen in FIG. 12, the base 50 is disposed between a pair of core elements 136 protruding downwardly from a bottom surface 138 of the upper core pin 108. The bottom surfaces 140 of the core elements 136 engage the top surface 118 of the lower core pin 110 to provide a shut-off therebetween. The core elements 136 also have opposed inner wall surfaces 142 which engage at their lower ends the outer edge surfaces 144 of the contact arms 52 in the shoulder regions of such arms and consequently pinch therebetween the contact essentially in line with the shut-off formed between the abutting surfaces 118 and 140. That is, the inner wall surface 142 of each core element 136 engages a respective edge surface 144 of the contact arm at the shoulder thereof to provide a shut-off which prevents molten material from flowing therebetween and into the cavity 116 from the region between the two core elements. This pinching engagement also serves to hold the contact in proper position during the molding of the shunt housing. The outer corners 148 of the base 50 preferably are beveled so that when the mold closes, the inner lower corners of the core elements 136 will engage the beveled surfaces 148 of an off center contact to urge the same to a centered position as the core elements move thereover.

As will be appreciated, the core elements 136 coact with the contact to close-off the open end of the core cavity 116 at the edges 144 of the contact while the side walls 126 of the cavity coast with the sides of the contact to close off the open end of the cavity at such side walls. As a result, molten material flowing into the mold cavity 114 exteriorly of the core 120 cannot flow into the cavity 116, except for some flash which might result if close tolerances are not maintained.

Each core element 136 also has an outer wall surface 150 which is sloped at a lower portion 152 thereof which may terminate at a relatively short transition surface extending to the bottom surface 140 as shown. Such sloping wall portion 152 defines with the top surface 118 of the lower pin core 110 a triangular region into which molten material may flow to form a respective stop 30 of the shunt housing.

As will be appreciated, especially when comparing FIG. 12 with FIG. 3, molten material may be introduced into the mold cavity 114 to form the shunt housing 16 illustrated in FIG. 3. The molten plastic material may be introduced into the mold cavity as by injection to form the housing. Preferably the molten plastic material flows around the base 50 of the contact 22 whereby the housing and contact will form an integral structure. The molten plastic material, however, is precluded from flowing into the cavity 116 and therefore from getting down into the tine area. Moreover, the molten plastic material of course cannot flow into the region occupied by the walls of the core pin surrounding the cavity. Accordingly, there will be formed within the housing the chamber 24. In addition, other details of the shunt housing will be provided, these including the stops 30 by the triangular region between the sloped surface 152 of the core elements 136 and upper end surface 118 of the lower core pin 110. Also the tapered opening 28 is provided by a sloped surface 158 at the upper end of the stripper pin 112 which extends circumferentially around the lower core pin 110.

In FIGS. 13–15, the lower core pin 110 is illustrated by itself. The lower core pin has at its upper end the above discussed hollow mold core 120 formed by the opposed side walls 126 and opposed end walls 124 which circumscribe the cavity 116 and give the mold core its characteristic O-shape as best seen in FIG. 15. At its end opposite mold core 120 the lower core pin 110 has an enlarged head 162 for a purpose discussed hereinafter.

In FIGS. 16–18 the stripper pin 112 is shown by itself. The stripper pin has the above mentioned sloping surface 158 which circumscribes the open top end of a passage 164 extending axially to the bottom of the stripper pin. The stripper pin also has at its lower end an enlarged head 166.

Figure 21:
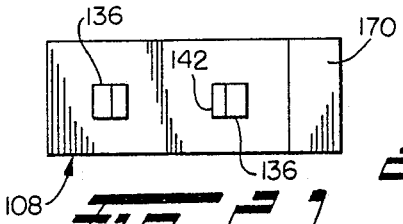
FIG. 21 is a bottom view of the upper core pin looking generally in the direction of the arrows 21—21 of FIG. 19.

In FIGS. 19–21 the upper core pin 108 is shown by itself. As shown, the upper core pin has an elongate body of rectangular shape. The pin has a bottom surface 138 from which the core elements 136 project downwardly. The upper core pin also has at its end opposite the core elements 136, i.e., its upper end, a retention flange 170. It perhaps should be noted here that the core elements 136 have a width preferably greater than the thickness of the contact 50 and most preferably a width about equal the width of the lower core pin. Further-more, the outer surfaces 150 of the core elements preferably are substantially in line with the outer surfaces of the end walls 124 of the lower core pin 110 as shown in FIG. 12.

Figure 22:
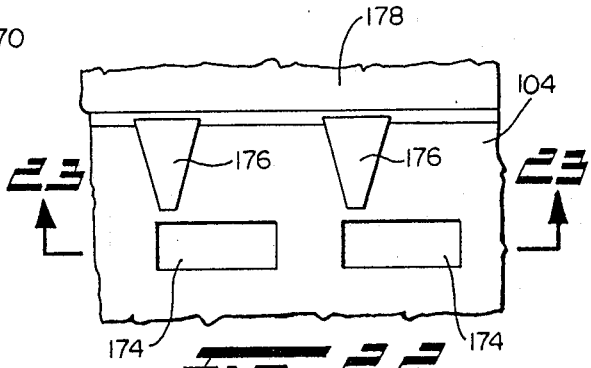
FIG. 22 is a partial top plan view showing a runner distribution system employed in the mold of FIG. 12.
Figure 23:
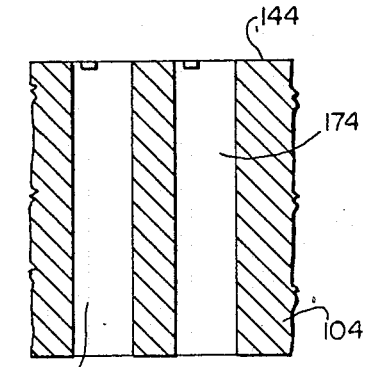
FIG. 23 is a partial section view of the lower half of the mold looking generally in the direction of the arrows 23—23 of FIG. 22.

In FIGS. 22 and 23, an exemplary runner distribution system for the mold is illustrated. As seen in FIG. 22, the lower mold half 104 can be seen to include two passages 174 which would have associated therewith respective lower mold core pins and stripper pins for defining respective mold cavities at the upper ends of such passages. The lower core pins and stripper pins, however, are not shown in FIG. 22. Of course, a typical mold would include a considerable number of cavities for forming simultaneously a plurality of the electrical shunts during each molding cycle.

As seen in FIGS. 22 and 23, each passage 174 has associated therewith a flow path groove 176 which delivers to the passage 174 molten material from a common runner 178. Each flow path groove 176 is formed in the top surface 144 of the lower mold half 104 and may have the illustrated tapered profile. Also, the bottom surface of the groove 176 may be tapered with its shallowest end most proximate the flow passage 174. Of course, in known manner, the upper sides of the flow path grooves 176 and runner 178 will be closed by the upper mold when the mold is closed for proper direction of molten material from the runner to the passages 174.

Figure 24:
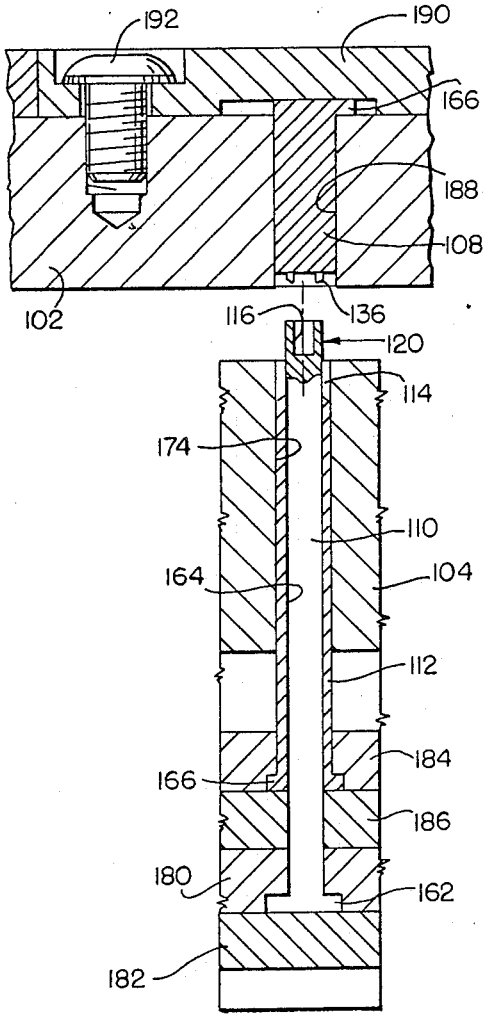
FIG. 24 is a partial section view showing further components of a production mold assembly having use in the manufacture of the electrical shunt.

In FIG. 24, further components of a production mold assembly are illustrated along with those above described. As shown, the stripper pin is located in the passageway 174 of the lower mold half 104 for axial movement. In turn, the lower core pin 110 is axially movable in the passageway 164 in the stripper pin. There should be minimal clearance, for example, less than .0005 inch, between the lower core pin 110 and the stripper pin 112 to prevent passage therebetween of molten material being injected into the mold cavity 114.

As seen at the bottom of FIG. 24, the molding apparatus includes a return plate 180 to which the lower core pin 110 is fixed for movement therewith by a return plate retainer 182. The molding apparatus also includes a stripper plate 184 to which the stripper pin 112 is fixed for common movement by a stripper plate retainer 186. The return plate preferably is biased towards the lower mold plate 104 against a stop preventing movement beyond that illustrated in FIG. 24. Conversely, the stripper plate is preferably biased away from the lower mold plate against a stop preventing further movement beyond the position illustrated in FIG. 24. There also preferably is provided a return pin operatively connected to the return plate which engages the upper mold half 102 during closure of the mold as contact is being made between the upper core pin and lower core pin to facilitate downward urging of the return plate and the lower core pin connected thereto against the biasing force thereby to avoid undue excessive forces acting on the relatively thin mold core walls and elements.

As seen at the top in FIG. 24, the upper core pin is retained in a passage 188 in the upper mold half 102 for movement with the upper mold half 102 by a retainer plate 190. The retainer plate 190 is secured to the upper mold half 102 by a fastener 192.

In operation of the apparatus illustrated in FIG. 24, the mold halves are urged together by conventional injection molding machine apparatus not illustrated to close the mold. As the mold halves are brought together, the core elements projecting from the bottom of the upper core pin will engage against the core pin 110 to urge the same downwardly against an upward biasing force. The upward biasing force ensures a tight seal between the shut-off surfaces of the core elements and the lower core pin. Of course, prior to closing of the mold, a contact will have been inserted into the mold core 120 and the core elements will engage the edges of the contact arms as above described. When the mold is completely closed, the various parts thereof will assume their relative positions illustrated in FIG. 12 at which time molten material may be injected into the mold cavity to form the housing of the electrical shunt.

After the molding material has cured sufficiently, the mold is opened by moving the upper and lower mold parts away from one another. As this is being done, ejector pins are operated to move the stripper plate upwardly through a stroke sufficient to push the shunt out of the upper end of the passage 174 and off the core pin 10. This preferably is accomplished simultaneously for each shunt being molded in the mold and suitable means may be provided for ejecting the sprue that would be formed in the runner 178 and associated delivery passages. In this manner, the shunts connected to the sprue may be removed as a single piece from the mold for further handling.

For further information concerning conventional injection molding procedures and apparatus, reference may be had to Bender et al U.S. Pat. No. 4,416,604.

STATEMENT OF INDUSTRIAL APPLICATION

In view of the foregoing, it will be appreciated that the electrical shunts according to the present invention may be employed to provide electrical interconnections between contacts already mounted on a printed circuit board, header, other electrical device, and so on.

We claim:

1. An electrical shunt comprising contact means for electrically connecting plural electrical members, said contact means including a unitary contact body having a base portion and a pair of compliant contacting portions extending from said base portion for electrically connecting respectively to plural electrical members, and housing means for supporting said contact means in operative position for effecting such connecting function with respect to the plural electrical members inserted with respect to said housing means and compliant contacting portions, said housing means including a molded body of electrically nonconductive material having therein an open chamber in which at least one of said compliant contacting portions is movable and exposed for electrically connecting with a respective one of the plural electrical members inserted into said chamber through an open end of said chamber at one side of said molded body, and said molded body being molded to and about said base portion of said unitary contact body to anchor said unitary contact body in said molded body.

2. The shunt of claim 1, wherein said contact body is generally U-shape with said compliant contacting portions extending from said base portion into said open chamber generally in a paired parallel relationship for engaging the electrical members inserted into said housing means.

3. The shunt of claim 2, wherein said compliant contacting portions have a resiliency characteristic whereby insertion of the electrical members into engagement with said compliant contacting portions effects balanced resilient deformation of said compliant contacting portions.

4. The shunt of claim 2, wherein said molded body is made of a nonresilient electrically insulating material.

5. The shunt of claim 2, wherein said compliant contacting portions are resiliently deflectable toward and away from each other within said chamber in said molded body.

6. The shunt of claim 1, wherein said molded body is made of a nonresilient electrically insulating material.

7. The shunt of claim 1, wherein said open end of said chamber permits insertion of the plural electrical members into said molded body in a first direction for connection to said compliant contacting portions, and said compliant contacting portions are resiliently flexible in said chamber within said molded body in a direction generally transverse to said first direction.

8. The shunt of claim 1, wherein said molded body has stop means at a second side thereof opposite said one side of said molded body and relatively remotely located with respect to said compliant contacting portions for limiting maximum insertion penetration of the electrical members into said molded body and for blocking insertion of the electrical members into said molded body from such second side.

9. The shunt of claim 1, wherein said molded body has, at a second side thereof opposite said one side of said molded body, opening means for passing therethrough the electrical members inserted through said open end for exposure of the electrical members at said second side.

10. An electrical shunt comprising contact means for electrically connecting plural electrical members, said contact means having a pair of contacting portions for electrically connecting respectively to plural electrical members, and housing means for supporting said contact means in operative position for effecting such connecting function with respect to such plural electrical members inserted with respect to said housing means and contacting portions, said housing means having opening means at one side thereof for exposing said contacting portions for connection to such electrical members, said contact means comprising a unitary flat planar contact body, said contact body being generally U-shape in the plane of said body and including a base portion and said contacting portions, and said contacting portions extending from said base portion generally in a paired parallel relationship to engage the electrical members inserted into said housing means.

11. The shunt of claim 10, wherein said housing means includes a single cavity containing both said contacting portions while permitting relative movement of said contacting portions towards and away from each other.

* * * * *